United States Patent [19]

Maresca

[11] Patent Number: 4,955,517

[45] Date of Patent: Sep. 11, 1990

[54] COMBINATION BACKPACK AND CHAISE

[76] Inventor: Carlo P. Maresca, 2220 Monte Vista Dr., Vista, Calif. 92084

[21] Appl. No.: 380,292

[22] Filed: Jul. 17, 1989

[51] Int. Cl.[5] ..... A45F 4/02

[52] U.S. Cl. ..... 224/155; 224/156; 297/411; 297/371; 297/229; 297/432; 297/129

[58] Field of Search ..... 224/155, 156, 153, 209, 224/210, 211; 297/411, 277, 371, 372, 219, 229, 432, 429, 129, 430, 435

[56] References Cited

U.S. PATENT DOCUMENTS 3,206,775 9/1965 Filson ..... 297/174
4,538,750 9/1985 Hanna ..... 224/156

FOREIGN PATENT DOCUMENTS 767225 7/1934 France ..... 297/372
2505158 11/1982 France ..... 297/411

*Primary Examiner*—Linda J. Sholl
*Attorney, Agent, or Firm*—Allan M. Shapiro

[57] ABSTRACT

The main chaise frame has left and right side rails to which legs are attached. A backrest is pivotally mounted on the side rails of the frame to be raised to a selected rest position. A leg rest is telescopically positioned from the main frame and thereupon a cover is attached over the main frame, the leg rest and the backrest. A back angular adjustment, arm rest and foot rest may also be provided. A backpack is secured to the frame by attachable straps, and has shoulder and waist straps for carrying the combination.

20 Claims, 3 Drawing Sheets

FIG. 1
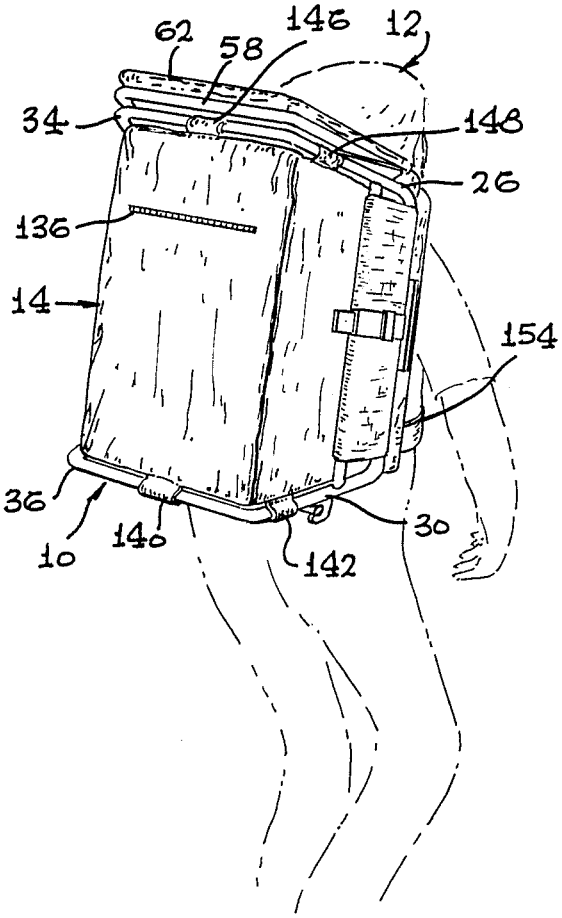
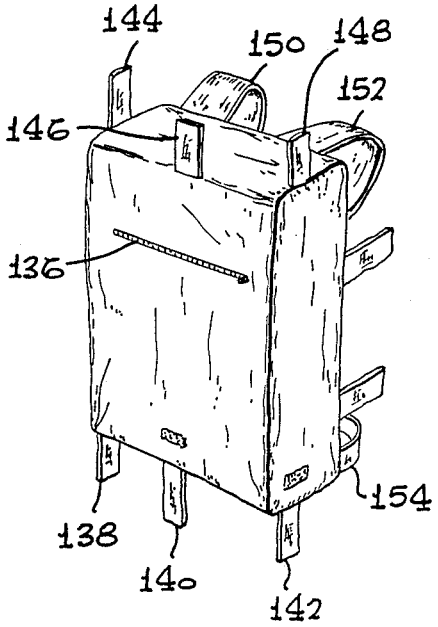
FIG. 9
FIG. 2
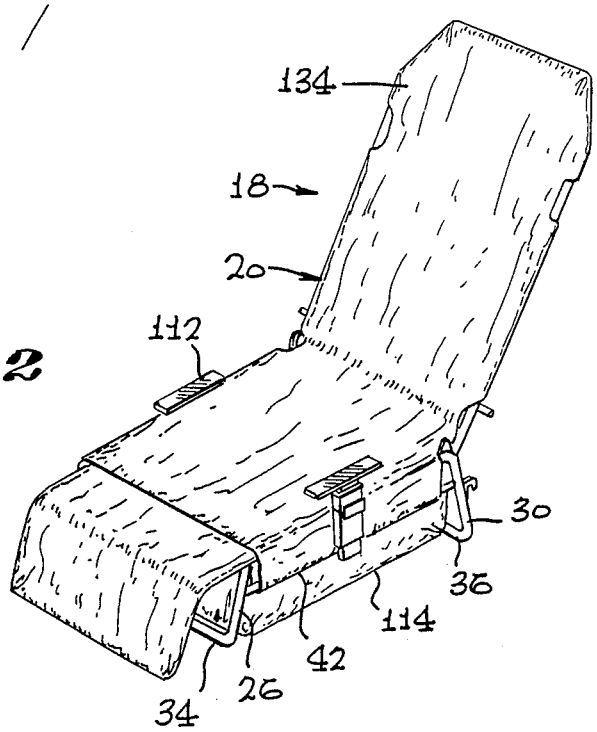

COMBINATION BACKPACK AND CHAISE

FIELD OF THE INVENTION

This invention is directed to a framework which, in its folded position, serves as the frame of a backpack. The backpack is secured thereto by the attachable straps and the backpack has shoulder and/or waist straps for carrying. The frame can be unfolded into the form of a chaise and a cover installed thereon for a person to recline thereon.

BACKGROUND OF THE INVENTION

Beachgoers must often walk a considerable distance from a location where they can leave their vehicle to a desired location away from the vehicle on the beach. The beachgoer often desires to take with him a comfortable chair, tanning oil, towel, bathing suit, and perhaps a snack and beverage. This burden makes quite an armful when traveling from the vehicle to the beach site. The beach site is often chosen based on proximity to the water and may be selected based on the other persons one expects to find at that site.

A combination backpack and chaise solves the problem of conveniently and easily carrying all of the supplies and the chaise to the site for convenient transit. Of course, it operates just as well in the opposite direction. All of the desired equipment can be conveniently carried in one trip.

SUMMARY OF THE INVENTION

In order to aid in the understanding of this invention, it can be stated in essentially summary form that it is directed to a combination backpack and chaise where a frame has the backpack strapped thereto. The frame is opened and its cover attached to serve as a sitting and resting place. The backpack may carry the cover to the site and may carry other desired goods.

It is thus an object and advantage of this invention to provide a combination backpack and chaise which can be easily carried to a site for convenient transportation of the chaise and other needs.

It is another object and advantage of this invention to provide a combination backpack and chaise wherein the chaise has a metal frame to form a seat with a back hingeably mounted thereon. A leg rest is slidably mounted on the main structure which forms the seat support so as to provide different configurations for different forms of support.

It is another object and advantage of this invention to provide a combination backpack and chaise which is inexpensive so that it is available to a wide section of the populace, is sturdy to provide proper support and long life, and is easy to transform from the backpack configuration to the assembled chaise configuration.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is an perspective view of the combination backpack and chaise of this invention, shown as being carried on the user's back.

FIG. 2 is a perspective view of the backpack and chaise, with the chaise assembled and with the backpack secured thereunder.

FIG. 9 is a isometric view of the backpack separate from the frame of the chaise.

DESCRIPTION OF THE PREFERRED EMBODIMENT

The combination backpack and chaise of this invention is generally indicated at 10 in FIG. 1. The backpack and chaise combination is shown as being carried on the back of person 12. The combination has shoulder straps to engage over the shoulders of the person and a waist strap to engage around his waist so that the combination backpack and chaise can be comfortably carried on the person's back between the site of use and the site of storage. The backpack 14 is separable from the chaise. The frame of the chaise is generally indicated at 16 in FIGS. 3 and 4. The erected chaise, with its cover, is indicated at 18 in FIG. 2. The cover is generally indicated at 20 in that figure.

Figure 3:
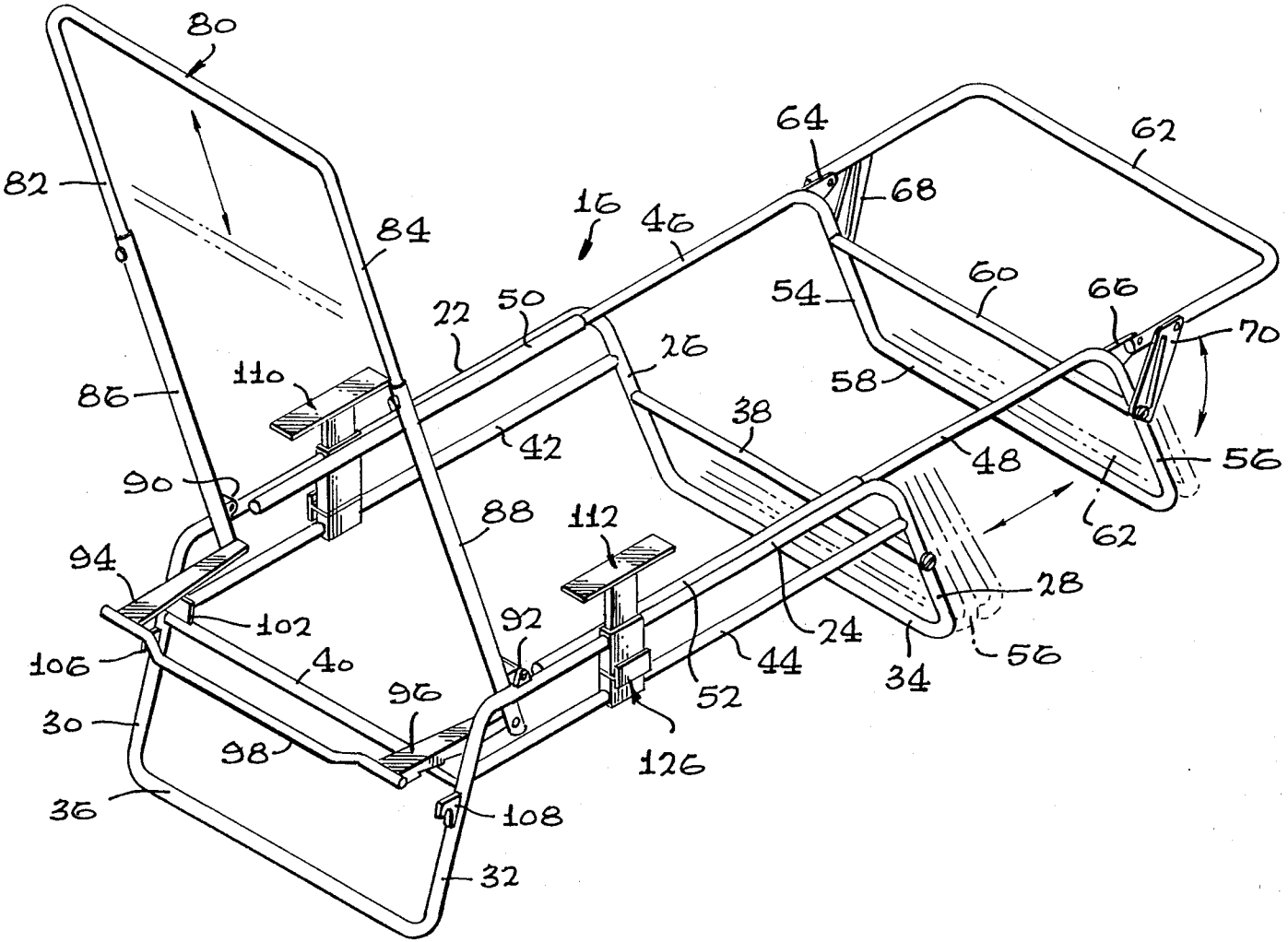
FIG. 3 is an isometric view of the frame of the chaise shown in the erected position.

The main frame of the chaise is a rigid structure which comprises left and right side rails 22 and 24. The left and right designations are applied as seen by the user sitting in the chaise. The front end of the left and right side rails are respectively turned down to form left and right front legs 26 and 28. Similarly, the rear ends of the left and right side rails are turned down to form left and right rear legs 30 and 32. At their lower ends, the front legs are joined by crossbar 34 and the rear legs are joined by crossbar 36. As is seen in FIG. 3, the side rails, front and rear legs and crossbars can be bent of a single member. All of the members are preferably of aluminum tubing or other lightweight and strong material. This structure forms the main frame of the chaise. The main frame is strengthened by crossbars 38 and 40, respectively between the front and rear legs and left and right lower side rails 42 and 44. The lower side rails are respectively below the left and right side rails and are respectively secured to the left legs and the right legs, as seen in FIG. 3. All attachments are preferably made by welding, or the like. It is to this structure to which the movable parts of the chaise are attached.

Left and right leg support rails 46 and 48 are telescopically received in left and right telescope tubes 50 and 52. The telescope tubes are respectively secured to the facing sides of the left and right side rails 22 and 24 so that the top of the telescope tube is the same height as the top of the side rail. This places the telescope tubes closer together than the side rails. The left and right leg support rails are suitably spaced to be slidably received in the telescope tubes. The leg support rails are joined at their forward end by left and right leg support legs 54 and 56. These legs are joined at their lower ends by cross rail 58. As is seen by the dashed line position in FIG. 3 and the full line position in FIG. 4, the leg support legs can be moved close to the front legs of the main frame when the telescope is closed, and as seen in FIG. 3, can be pulled forward to an extended position. Cross bar 60 is secured to the leg support legs above cross rail 58 to provide strength to the system.

Figures 4, 5, 6, 7, 8:
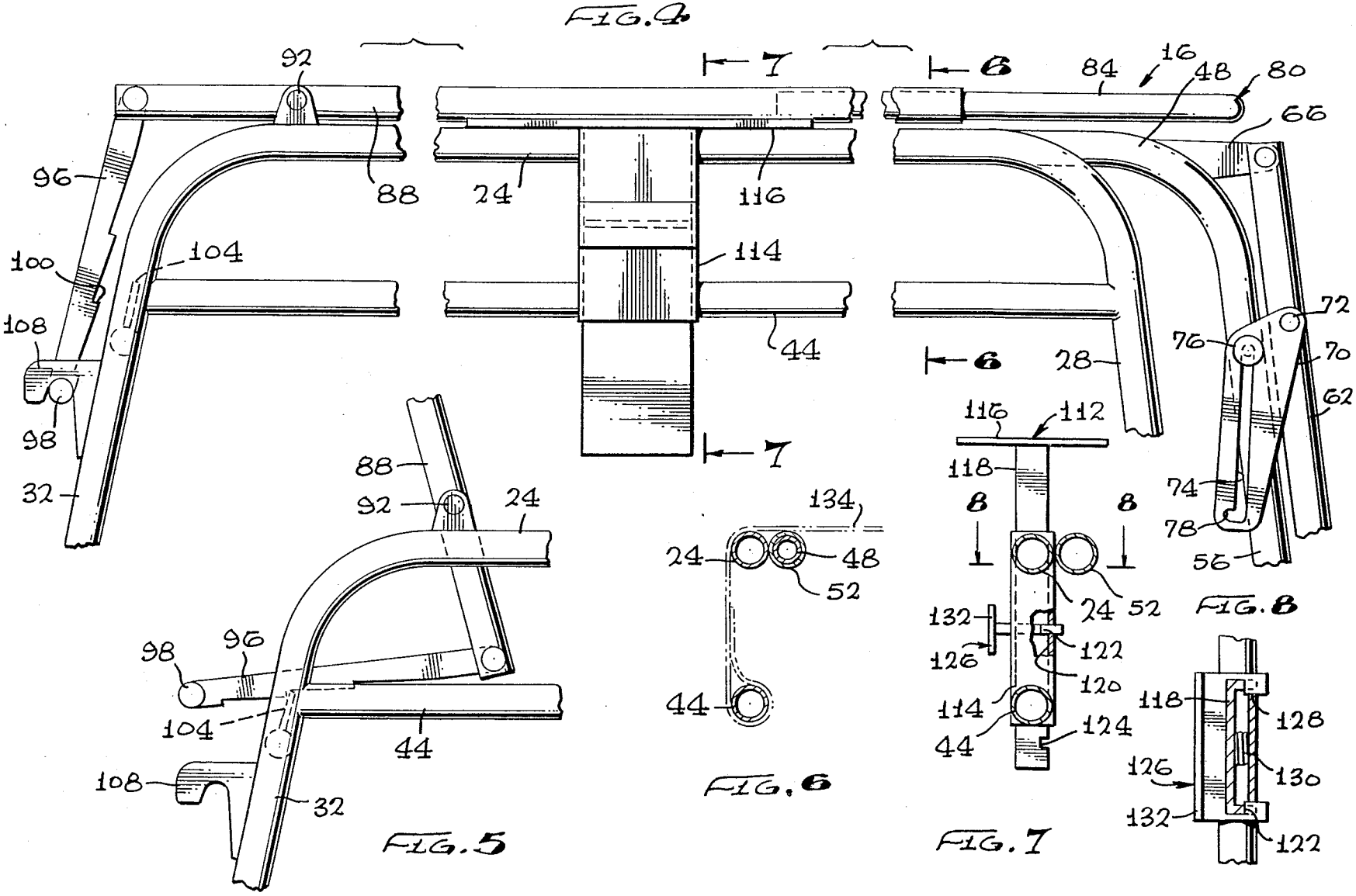
FIG. 4 is a side-elevational view of the frame of the chaise, on a larger scale than FIG. 3, showing the chaise in the folded position, with parts broken away.
FIG. 5 is an enlarged side-elevational view of a portion of the frame of FIG. 4, showing the backrest in raised position, with parts broken away.
FIG. 6 is section taken generally along line 6—6 of FIG. 4.
FIG. 7 is a section taken generally along the line 7—7 of FIG. 4.
FIG. 8 is a section taken generally along line 8—8 of FIG. 7.

In order to further extend support, foot support loop 62 is provided. The foot support loop 62 is U-shaped and made of the same aluminum tubing. At its open end toward the back of the chair, it is pivoted on flanges 64 and 66 which are secured to the left and right leg support rails 46 and 48, where they bend downwardly to form legs 54 and 56. In order to releasibly hold the foot support loop 62 in the raised position shown in FIG. 3, stop plates 68 and 70 are mounted on pivot pins on the sides of the foot support loop 62. The stop plate 70 is shown in more detail in FIG. 4 where it is mounted on pivot pin 72. Stop plate 70 has a slot 74 therein. The slot engages upon stop pin 76 to permit upward swinging motion of the foot support loop 62 to the position shown in FIG. 3. Hook 78 in the slot engages on stop pin 76 to detachably retain the foot support loop in the raised position. Thus, two additional extensions of leg and support can be achieved beyond the main frame of the chaise, and these extensions can be telescoped and pivoted down to occupy minimum space, as seen in FIG. 4.

Backrest 80 is structural tube formed into a U-shaped configuration. The left and right arms 82 and 84 of the backrest respectively telescopically slide into backrest tubes 86 and 88. The tubes 86 and 88 are respectively pivoted on pins 90 and 92. The pins are carried on bosses respectively secured to the left and right side rails near the rear end thereof. The bosses are raised enough so that, when the backrest lies forward in its folded position, the backrest lies just above the slide rails with a slight space therebetween. The height of the backrest telescoping tubes and the shape of the telescoping portion of the backrest are such that, when the backrest is folded forward, the top of the backrest lies adjacent foot support loop 62, as seen in FIG. 4. This structure is such that the backrest can lie forward in the folded position. When raised, the upper loop of the backrest may be raised above its telescoping tubes and may be held in the raised position by any convenient detent .

The angle of the back with respect to the main frame of the chaise is controlled by back stops 94 and 96, which are respectively pivoted on the lower ends of backrest telescopic tubes 86 and 88, below their pins 90 and 92. The back stop 96 is shown in more detail in FIGS. 4 and 5, and the back stop 94 is symmetrically identical. The back stops are joined by cross bar 98 so they act together. Each of the back stops has saw teeth on the bottom thereof. Saw tooth 100 is particularly illustrated in FIG. 4. The particular purpose of the saw teeth is to retain the backrest in a selected angular position. To this end, bars 102 and 104 are mounted on top of the cross bar 40 adjacent its ends so that they are positioned directly under the back stops 94 and 96. In FIG. 5, the saw tooth 100 (specifically identified in FIG. 4) is engaged upon bar 104. The geometry is such that the back 80 is retained at a selected angle. The different saw teeth provide different rest angles of the back 80. When the backrest is in the forward, folded position shown in FIG. 4, the back stops 94 and 96 must be restrained. Restraint is accomplished by means of hooks 106 and 108 respectively mounted on legs 30 and 32. As seen in FIG. 4, when the back is in the forward position, the ends of the cross bar 98 are engaged in the hooks 106 and 108 to restrain the back stops.

Arm rests 110 and 112 are provided. Arm rest 112 is shown in more detail in FIGS. 7 and 8. Arm rest housing 114 is secured to right side rail 24 and right lower side rail 44. Housing 114 has a vertical slot therethrough. The arm rest itself has a pad 116 and post 118. The post extends downwardly through the slot 120 in the housing. Post 118 is in the form of a shallow channel, as seen in FIG. 8. As seen in FIGS. 7 and 8, the post 118 has a series of notches therein, with notches 122 and 124 being shown in FIG. 7 and notch 122 being shown in FIG. 8. The height of the arm rest is controlled by means of stop plunger 126. The stop plunger wraps around post 118, as seen in FIG. 8, and has dogs which engage in the post notches. Dog 128 is shown. Spring 130 resiliently urges the dogs into the notches. By pressing on the actuation plate 132 on the front of the stop plunger, the dogs are disengaged from the notches so that the height of the pad 116 can be adjusted. In the lowermost position, the pad 116 lies directly over side rail 124, as seen in FIG. 4, to permit the back to come down as far as possible.

The chaise cover 134 is shown in FIG. 2. It is preferably made of sturdy fabric and preferably has a pocket at its top in which is received the loop of the backrest. In arranging the chaise for use, it is erected from the configuration of FIG. 4 to the configuration of FIG. 3. The chaise cover is placed thereon by engaging its pocket over the backrest and pulling the fabric down over the main frame. On the seat portion of the main frame, the chaise cover is pulled over the side rails, is engaged under the lower side rails, and is secured to itself, as by Velcro or other detachable fastening means. This portion of the application of the chaise cover is shown in FIG. 6. A separate foot rest cover is employed for leg and foot support. It preferably has a pocket therein for receipt of the foot support loop, as seen in FIG. 2. The cover then engages around leg support rails 46 and 48 and attached to itself by convenient detachable fastening means such as Velcro. With the cover on, the foot rest may be raised or lowered and the angle of the backrest adjusted. In this way, comfort is achieved. When it is time to fold up, the cover is removed and the framework part of the chaise is moved into the folded, compact position of FIG. 4.

Backpack 14 is seen in FIGS. 1 and 9 and is shown under the assembled chaise in FIG. 2. Backpack 14 has convenient openings means, such as zipper 136, to permit access to the contents of the backpack and to permit storage in the backpack. The chaise cover may be stored therein. As previously discussed, various beach goods, such as towels, suits and suntan lotion, may be packed therein, as well as other needed or desired equipment. The backpack is attached to the folded chaise frame by means of a plurality of straps. Straps 138, 140 and 142 are shown at the bottom end of the pack in FIG. 9 to engage around the left and right rear legs and cross bar 36. Similarly, straps 144, 146, and 148 are provided to engage around the front legs 26 and 28 and front crossbar 34. As seen in FIG. 9, additional straps are provided to engage around the side rails. This secures the pack in place between the legs of the folded chaise. The configuration of the chaise is such that, when the chaise is folded, as seen in FIG. 4, there is a space between the side rails and the back telescoping tubes 86 and 88 to permit the wearer's back to fit therebetween. In this way, the back rests against the pack for a comfortable fit. Conventional straps are provided on the backpack 14 for carrying. For example, shoulder straps 150 and 152 are provided to engage over the shoulders of the person 12, and waist belt 154 is provided to engage around the waist of the person for comfortable carrying. In this way, the backpack and chaise can be comfortably carried to and from the site where it is used and may be used as an enjoyable resting device.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A combination pack and chaise comprising:

a main frame, side rails on said main frame, four legs on said main frame including left and right front legs and left and right rear legs;

a pack secured to said main frame and mounted below said side rails of said main frame and between said legs of said main frame;

a leg rest slidably mounted with respect to said frame, said leg rest having a left leg and a right leg, said leg rest being slidably mounted so that said leg rest legs can be moved from a position adjacent said front legs of said main frame to a position away from said front legs of said main frame;

a backrest, said backrest being pivoted on said main frame so as to move from a folded position where it lies parallel to said frame to a position where it is raised with respect to said frame to serve as a backrest main frame;

a chaise cover removably mounted on said backrest frame, mounted on said main frame and above said pack and said leg rest so that the frame of said chaise can support a person while said pack serves as storage while said chaise supports a person and said cover can be removed from said frame, stored in said pack so that said combination pack and chaise can be carried on the back.

2. The combination pack and chaise of claim 1 wherein said pack is detachable from said main frame.

3. The combination pack and chaise of claim 1 wherein said backrest lies parallel to said side rails when in its folded position and lies at an acute angle with respect to said side rails when in its raised, back-supporting position.

4. The combination pack and chaise of claim 3 wherein said backrest comprises backrest tubes pivotally mounted to said side rails and a backrest telescopically mounted with respect to said tubes to permit raising the height of said backrest.

5. The combination pack and chaise of claim 3 wherein said backrest is provided with locking means thereon for locking said backrest at a selected angular position with respect to said side rails.

6. The combination pack and chaise of claim 5 further including left and right arm rests mounted on said side rails, said arm rests being adjustably mounted with respect to said main frame and being in a lowered position when said backrest is in its folded position substantially parallel to said side rails of said main frame.

7. The combination pack and chaise of claim 5 further including a foot rest mounted on said leg rest, said foot rest being pivotable from a folded position where it lies substantially against said legs of said leg rest to a raised position.

8. A combination pack and chaise comprising:

a main frame, side rails on said main frame, four legs on said main frame including left and right front legs and left and right rear legs;

a pack secured to said main frame and mounted below said side rails of said main frame and between said legs of said main frame;

a leg rest slidably mounted with respect to said frame, said leg rest having a left leg and a right leg, said leg rest being slidably mounted so that said leg rest legs can be moved from a position adjacent said front legs of said main frame to a position away from said front legs of said main frame;

a back rest comprising back rest tubes pivotally mounted to said side rails and extending therebelow so that said tubes lie parallel to said side rails when in folded position and lie at an acute angle with respect to said side rails with one end in raised, back-supporting position, a back rest telescopically mounted with respect to said back rest tubes to permit raising the height of said back rest, locking means for said back rest comprising a back stop in the form of a toothed bar having a plurality of teeth thereon, said tooth bar being attached to the end of said back rest tube below said pivot, said back stop being pivoted to said backrest and a stop bar mounted on said main frame for engagement by said toothed bar so that engagement of different teeth on said stop bar provides different back angle stop positions; and a chaise cover removably mounted on said backrest frame, mounted on said main frame and above said pack and leg rest so that the frame of said chaise can support a person while said pack serves as storage while said chaise supports a person and said cover can be removed from said frame, stored in said pack so that said combination pack and chaise can be carried on the back.

9. The combination pack and chaise of claim 8 further including retaining means for retaining said toothed bar in position when said backrest is folded parallel to said side rails.

10. The combination pack and chaise of claim 9 wherein said backrest comprises backrest tubes pivotally mounted to said side rails and a backrest telescopically mounted with respect to said tubes to permit raising the height of said backrest.

11. A combination pack and chaise comprising:

a main frame, said main frame having upper and lower left side rails and upper and lower right side rails, a left front leg attached to the forward end of said upper and lower left side rails and a left rear leg attached to the rear end of said upper and lower left side rails, a front right leg attached to the forward end of said upper and lower right side rails and a right rear leg attached to the rear of said upper and lower right side rails, a front cross bar connecting said front legs below said top side rails and a rear cross bar connecting said rear legs below said top side rails so as to provide a recess therebetween;

a pack attached to said main frame between said side rails and between said legs for storage of materials under said chaise when said chaise is in use;

a leg rest telescopically mounted with respect to said main frame, said leg rest having a left leg and a right leg, said leg rest legs lying adjacent said front legs of said main frame when said leg rest is in a closed position and being spaced from said front legs of said main frame when said leg rest is extended;

a U-shaped back rest pivotally mounted on said left and right upper side rails, said U-shaped backrest having a cross bar which lies adjacent said front legs of said main frame when said backrest is in its folded position, said backrest being pivotable to a raised position when it lies at an acute angle with respect to said side rails, stop means interconnected between said backrest and said main frame to detachably retain said backrest in its raised position; and a cover removably attached to said main frame, said leg rest and said backrest frame, said cover being storable in said pack when said chaise is folded so that said pack can lie against the back of the user to carry said pack and folded chaise.

12. The combination pack and chaise of claim 11 wherein said frost bar of said backrest is adjustably positionable with respect to said pivotal mounting of said backrest.

13. The combination pack and chaise of claim 11 wherein said detachable stop means has a plurality of stops thereon so that said backrest can be disengageably secured at any one of a plurality of different angular positions with respect to said side rails.

14. The combination pack and chaise of claim 13 wherein said cross bar of said backrest is adjustably positionable with respect to said pivotal mounting of said backrest.

15. The combination pack and chaise of claim 14 further including a foot rest pivotally mounted on said leg rest, said foot rest having legs which lie adjacent said legs of said leg rest when in the folded position and lie away from said legs of said foot rest when in the raised position.

16. The combination pack and chaise of claim 11 further including a foot rest pivotally mounted on said leg rest, said foot rest having legs which lie adjacent said legs of said leg rest when in the folded position and lie away from said legs of said foot rest when in the raised position.

17. The combination pack and chaise of claim 16 further including left and right arm rests respectively secured to said left and right side rails, said arm rests being adjustable with respect to said side rails from a lowered position wherein they lie between said backrest and said side rails when said backrest is in its lowered position into a raised position.

18. The combination pack and chaise of claim 11 further including left and right arm rests respectively secured to said left and right side rails, said arm rests being adjustable with respect to said side rails from a lowered position wherein they lie between said backrest and said side rails when said backrest is in its lowered position into a raised position.

19. The method of providing seating for a person at a remote position comprising the steps of:

carrying strapped on his back a pack having a chaise frame attached thereto to a site for resting on the chaise;

pivotally raising a backrest on the chaise frame to a selected angular position;

telescopically sliding a leg rest outward from the chaise frame;

removing from the pack a chaise cover and attaching the cover to the chaise frame;

retaining the pack under the chaise for storage of other equipment and materials in the pack under the chaise while attached to the chaise; and thereupon resting on the chaise.

20. The method of claim 19 further including the steps of:

carrying other desired equipment and materials in the pack;

storing the other desired equipment and materials in the pack under the chaise while the chaise is in use; and removing the other desired equipment and materials from the pack under the chaise while the chaise is in use and utilizing them at the site of resting on the chaise.

* * * * *